US005271347A

United States Patent [19]

Carreras Fontcuberta

[11] Patent Number: 5,271,347

[45] Date of Patent: Dec. 21, 1993

[54] PROCESS AND ASSOCIATED APPARATUS FOR JOINING AUTOMATICALLY THE BEGINNING AND THE END OF A HEM IN A CIRCULAR TEXTILE MATERIAL

[76] Inventor: Francisco Carreras Fontcuberta, Mossen Ramón Giralt 53, Caldes de Montbui (Barcelona), Spain

[21] Appl. No.: 703,388

[22] Filed: May 21, 1991

[30] Foreign Application Priority Data

May 25, 1990 [ES] Spain ..... 9001457

[51] Int. Cl.[5] ..... D05B 35/02; D05B 35/10

[52] U.S. Cl. ..... 112/262.2; 112/262.3; 112/63; 112/143; 112/153; 226/17

[58] Field of Search ..... 112/143, 141, 63, 147, 112/262.2, 121.26, 262.1, 262.3, 153; 226/15, 17, 21, 180, 45

[56] References Cited

U.S. PATENT DOCUMENTS

| | | | |
|---|---|---|---|
| 3,865,058 | 2/1975 | Rovin et al. | 112/143 X |
| 3,890,911 | 6/1975 | Babson et al. | 112/121.12 |
| 4,473,017 | 9/1984 | Letard et al. | 112/121.26 X |
| 4,479,447 | 10/1984 | Rohr | 112/63 X |
| 4,665,848 | 5/1987 | Michaels et al. | 112/121.26 |
| 4,947,771 | 8/1990 | Miyachi et al. | 112/147 X |

FOREIGN PATENT DOCUMENTS

| | | |
|---|---|---|
| 0177149A1 | 4/1986 | European Pat. Off. . |
| 2130377.5 | 12/1971 | Fed. Rep. of Germany . |
| 2632551.9 | 3/1977 | Fed. Rep. of Germany . |
| 3831034A1 | 3/1989 | Fed. Rep. of Germany . |
| 2066307A | 7/1981 | United Kingdom . |

*Primary Examiner*—Peter Nerbun
*Attorney, Agent, or Firm*—Darby & Darby

[57] ABSTRACT

A process and associated apparatus for joining automatically the beginning and the end of a hem in a circular textile material is disclosed. The material is fed on to an entry roller which receives the cloth from a flat guide, the said roller being inclined at the moment of the initial introduction of the material followed by the material being fed and guided with the principal roller being horizontal, this being followed by the pre-folding and final folding of the edge of the material by fold guides prior to the stitching of the hem until the already sewn section of the hem reaches the entry of the guide unit, at which moment the said unit is displaced for the realignment of the hem stitching zone, following which the fold guides are separated.

7 Claims, 6 Drawing Sheets

PROCESS AND ASSOCIATED APPARATUS FOR JOINING AUTOMATICALLY THE BEGINNING AND THE END OF A HEM IN A CIRCULAR TEXTILE MATERIAL

BACKGROUND OF THE INVENTION

Many forms of so called circular, or endless cloths or textile materials require a hem on the full periphery of the cloth and various machines have been developed to provide this continuous hem which can then contain within its interior an elastic band, with the final stage of ending the hem being a manual operation.

Circular cloths requiring such a closed form include fitted bed linen, table cloths and others where the cloth has to cover the object in question with its periphery adapted so that it encloses the the said object laterally. The final shape of the cloth, though denominated as circular need not be of that shape but could equally be square, rectangular or any other shape.

OBJECT OF THE INVENTION

The process and the apparatus has as an object the improvement of the machines currently known and employed for this purpose but providing a fully automatic operation to form the hem completely including the final stage of joining up the beginning of the hem with the end, the operation currently carried out by hand.

This present invention renders therefore the forming of the hem in a circular cloth a fully automatic process.

BRIEF DESCRIPTION OF THE INVENTION

To achieve this objective the invention is based on a process and apparatus which coordinates the relative movements of the various operating devices which guide and sew the cloth on which the hem is required, commencing with the initial phase of the straight stitching of the hem then proceeding to the second phase in which the alignment of the material guide is altered for the final stitching as well as the plane of the feed-in of the cloth for carrying out the final stitching and then leading to a third phase in which the beginning and the end of the hem are stitched together with the machine then automatically coming to a stop and the cloth being ejected. All these stages being carried out automatically.

The apparatus designed to carry out this process has a first guide device, a second device for the first folding and final fold prior to stitching, the two devices being synchronized together with the various sections of the machine in which they are located and which correspond partly to currently known technical means of producing the work indicated herein.

As an essential feature the guide unit has a vertical guide zone consisting of flat plates constraining the cloth there between a guide roller following, and a system of pressure actuated rollers, adjustable at will, to provide the cloth alignment, the position being detected by a system of photo-electric cells, the whole assembly being carried on an arm which is mounted at entry and exit located on a shaft which is parallel to the roller so as to provide for the two different positions of the assembly for guiding and feeding.

The device for first and second folding, in this invention, comprises an arrangement which has a provision for detecting the previously made hem, causing the machine to stop and ejecting the cloth.

BRIEF DESCRIPTION OF THE DRAWINGS

For a better understanding of this specification explanatory drawings are provided showing by way of an example the process and the associated apparatus, objects of this present patent.

DETAILED DESCRIPTION OF THE INVENTION

Figure 1:
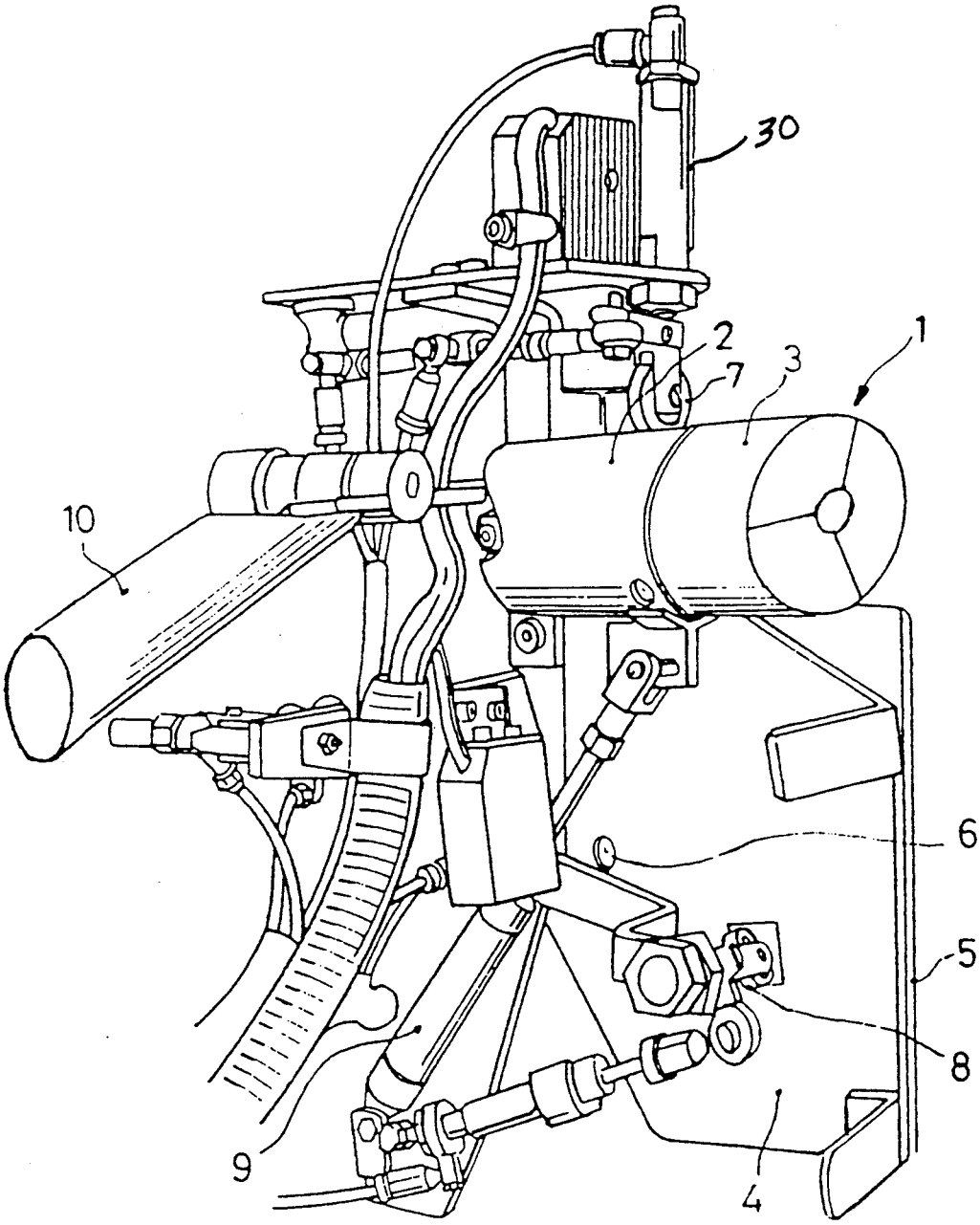
FIG. 1 is a perspective view of the guide and feed unit for the cloth according to this invention.

As may be seen in FIG. 1 the guide and feed unit comprises a main roller 1 made up of two sections 2 and 3, one section 2 of which is fixed and the other section 3 mobile, this roller receiving the cloth which comes from a guide formed by the plates 4 and 5, the first plate 4 of which is fixed while the second plate 5 can swing on a vertical hinge located on the edge opposite that seen in the figure, these two parts 4 and 5 providing guidance of the cloth which then passes to the roller 1. The cloth passes between plates 4 and 5 over the main roller 1. Photo-electric cells locate the position of the cloth edge, the orifice 6 show-the position of one of them. The photo cells secure alignment of the material. When the cloth is misaligned the alignment roller 7 acts on the cloth against fixed section 2 of the feed roller by action of the piston and cylinder device 30 and the roller 8 acts on the cloth against the plate 5, both these rollers being set at a particular angle and coming into operation intermittently to realign the edge of the cloth until it arrives at its correct position.

So as to allow the roller 1 to take up a horizontal working position and a position which is slightly inclined downwards for the entry and the ejection of the cloth, the rotating roller section 3 is mounted on a horizontal shaft capable of being acted on by a lower piston and cylinder assembly 9 which can cause an angular movement of the entire roller 1 between the horizontal and slightly inclined positions.

At the same time a forward movement along an axis parallel to roller 1 of the guide and feed unit is required so that the cloth can be fed at its normal stitching position along almost the entirety of the hem, and then fed in another position corresponding to the final stage of joining the beginning and the end of the hem. At this point it is necessary that the alignment of the stitching changes in relation to the stitching head so as to take into account precisely the presence of the already existing hem. To this effect an arm 10, which carries the entire guide and feed assembly can move vertically and laterally and thus assume the two required alignment positions.

Figure 2:
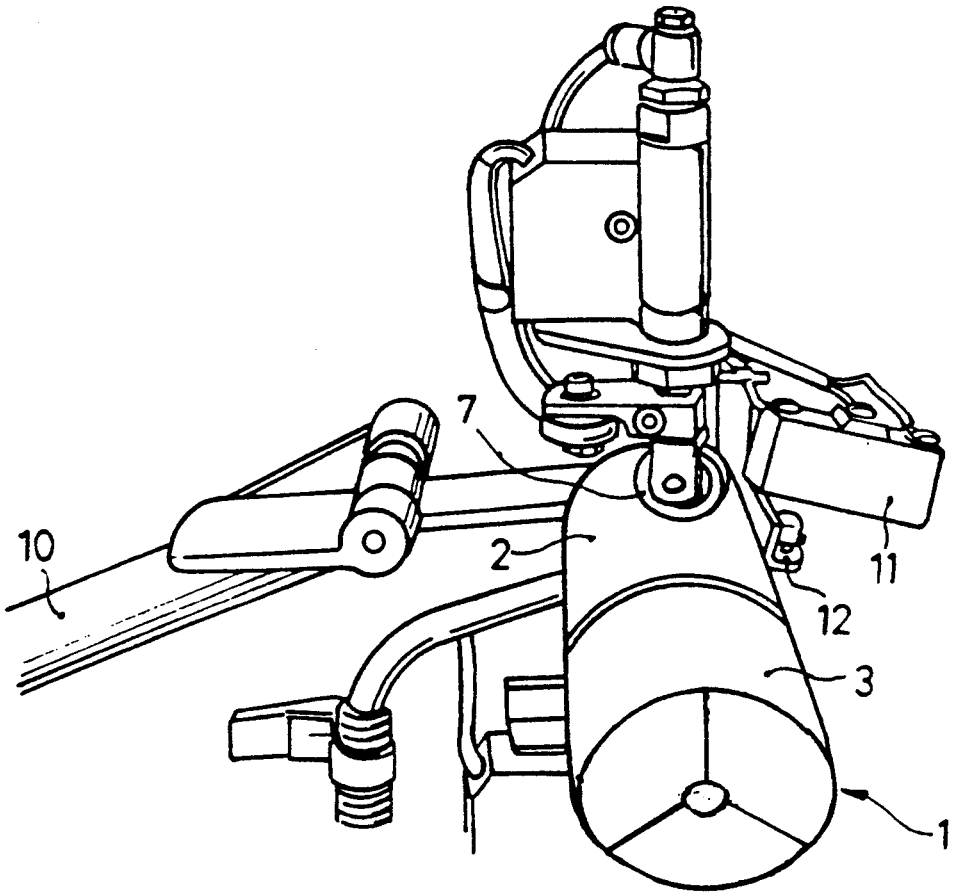
FIG. 2 is a perspective view of the same unit as in FIG. 1 shown from what is approximately the front part of the feed roller.

In conjunction with the roller 1, a micro-switch 11, FIG. 2, with a mobile arm 12 can operate and detect the entry of the already existing section of hem, signalling to a programmer which can cause the above mentioned changes of alignment and which can then allow the operation of joining the beginning and the end of the hem to take place.

Figure 3:
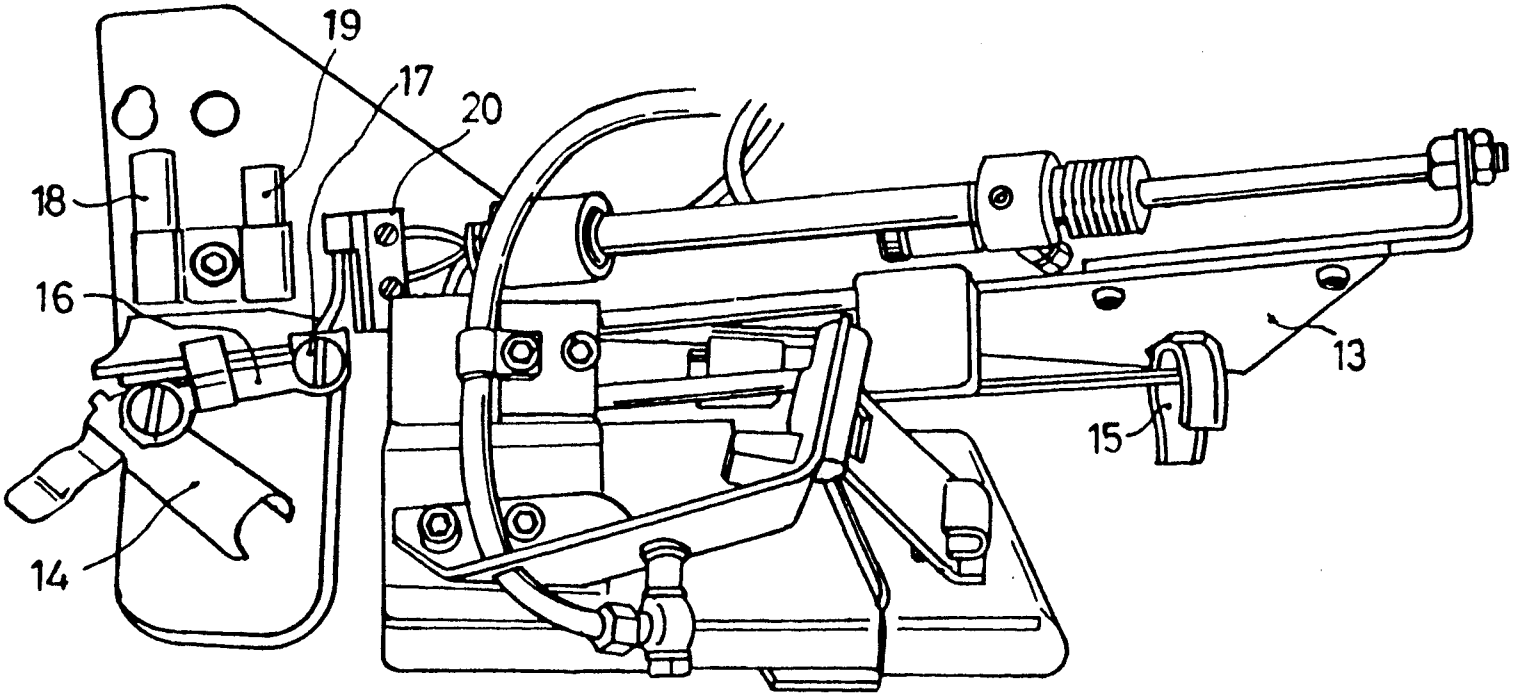
FIGS. 3 and 4 show respectively the unit for the first and second fold operations.
Figure 4:
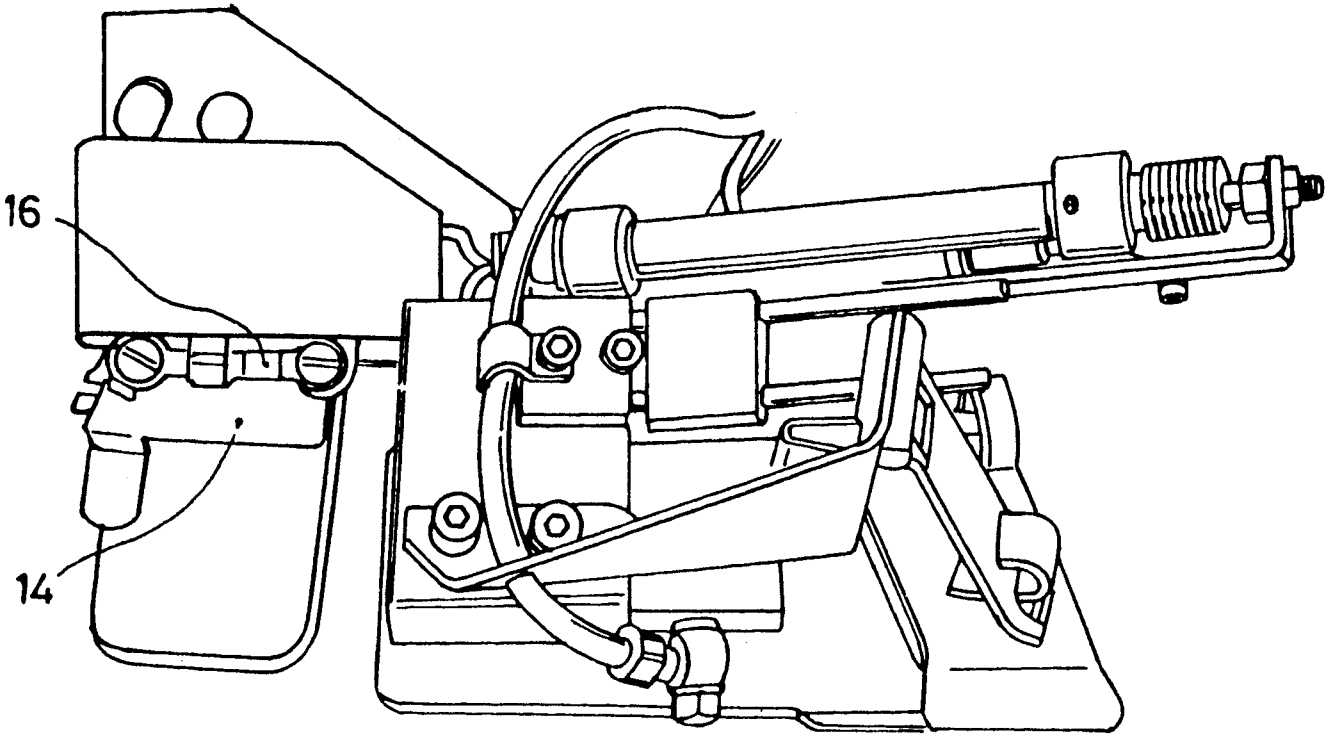
Figure 5:
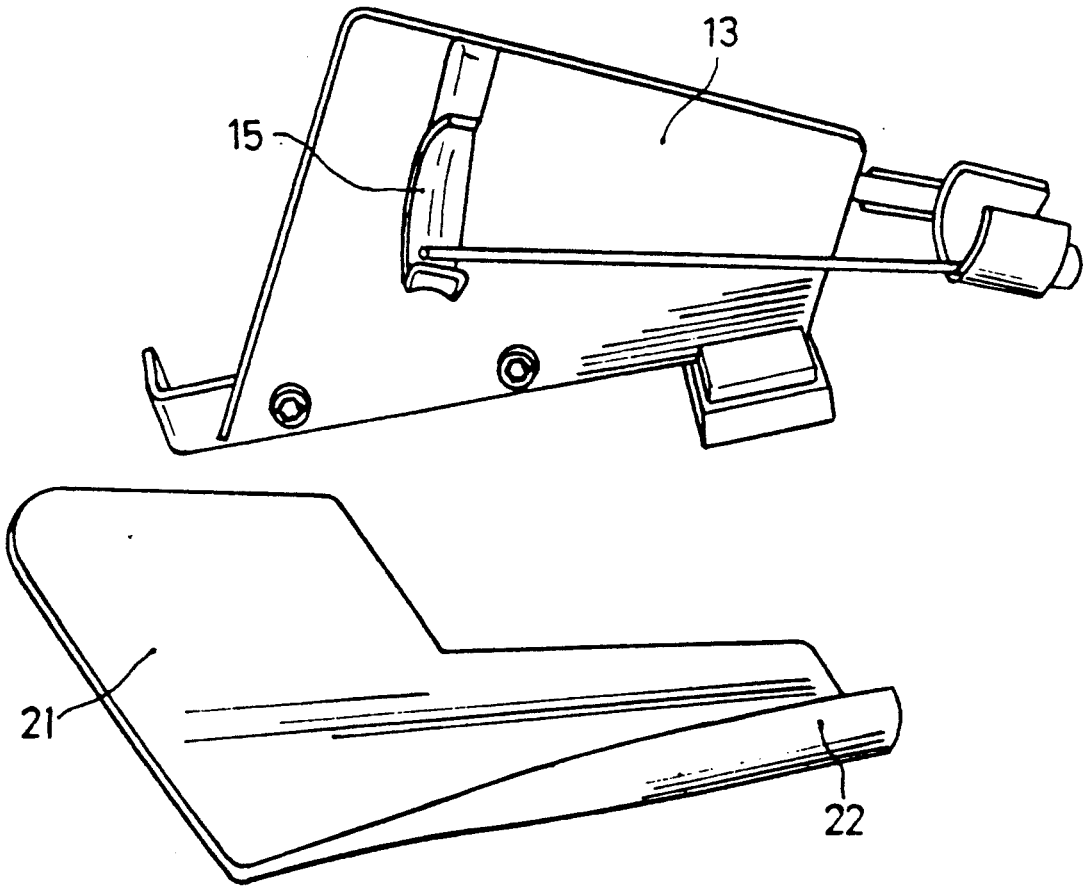
FIG. 5 shows a variant of the component for the initial folding.
Figure 6:
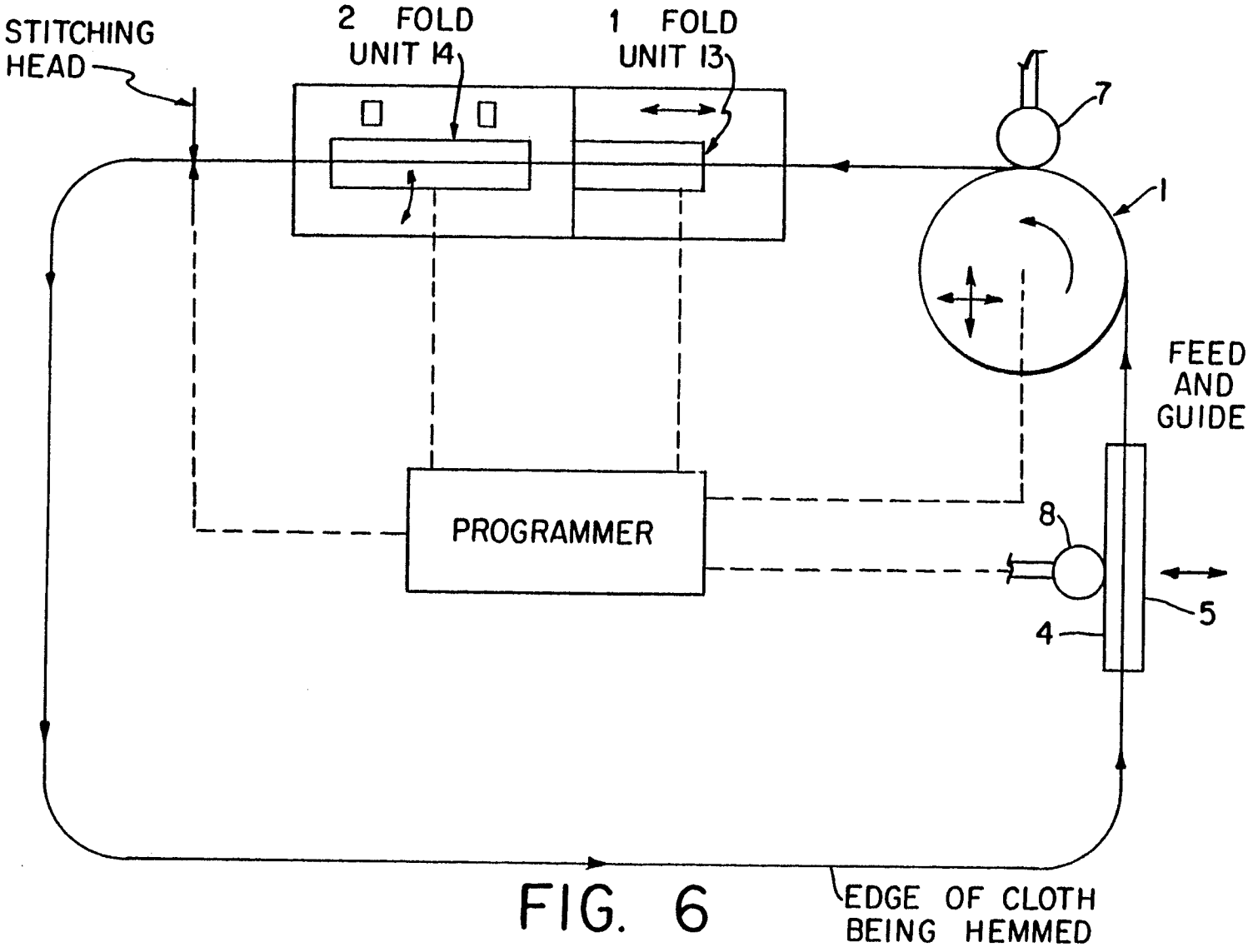
FIG. 6 is a diagram showing the overall operation of the apparatus.

The guide and feed unit operates in conjunction with the first and second fold guide unit shown in FIGS. 3 and 4 in which may be seen the first fold guide device 13 and the final fold guide device 14 of the double articulation type. On entry, the cloth undergoes its first fold by means of the open ring 15 or by means of a semi-enveloping pre-folding device 21 with a lateral wing 22, FIG. 5, then passing to the final folding device 14 which is hinged to a mobile member 16 which in turn can rotate on an axis 17. This mobile member 16 is held by two magnets, one being the main magnet 18 and the other the secondary one, 19 with the magnetic strength of magnet 19 being less than that of the magnet 18, the latter providing the effective retention of the member 16 in its closed position, corresponding to FIG. 4, that being the position of the normal stitching of the hem by the external sewing machines. On arrival of the already stitched hem extremity, which has to be joined to the other extremity of the hem, the guide device 14 moves outwards as shown in FIG. 3, operating the micro-switch 20 and thus causing the machine to stop and the cloth to be ejected. This is accomplished by occurrence of transmitting a signal to the programmer, causing the plate 5 to swing on its axis to open, and the machine to stop and the roller 1 to descend and allow the ejection of the cloth.

The above arrangements render possible the objects of this present patent, which provide for a first phase in which the cloth is guided towards the pre-fold and folding unit. Then, at the moment when the already hemmed extremity reaches the guide unit, the assembly takes up a second position of alignment of the stitching in relation to the stitching head. Then proceeding, once the already made section of hem passed the pre-fold and folding device, the hem ends are joined and a micro-switch is actuated which stops the machine, causes the downward swing of the guide roller and opening of the guide plate causing in turn the ejection of the cloth.

The above means as indicated permit the carrying out of the process as described with the result that the machine can operate automatically in joining the beginning to the end of the hem in the so-called circular cloths of textile material.

The interior of the hem may have within it a cord or elastic as the case may be.

Anything not modifying altering or changing the essence of the described process is a variant of this invention.

I claim:

1. A process for joining automatically the beginning and the end of a stitched hem in a circular textile material comprising the steps of:

feeding the material on an entry roller of a guide unit from between the plates of a flat guide, said roller being inclined at the initial introduction of the material and the material guided with the axis of the roller being aligned with a horizontal plane, providing guides for pre-folding and final folding the edge of the material prior to the stitching of the hem at a stitching zone and folding the material moving through said guides, stitching a hem until the section of the hem already stitched arrives at the entry of the guide unit, detecting the presence of the beginning of said stitched hem at said guide unit, separating the fold guides for final folding when the already stitched hem arrives thereat, sewing the beginning and the end of the hem together, stopping the machine and inclining the entry roller to a non-horizontal orientation and ejecting the fully hemmed material.

2. An apparatus used with a sewing machine for joining automatically the beginning and the end of a hem made by the sewing machine in a circular textile material comprising:

a guide and feed unit equipped with a main entry roller mounted for inclination in relation to the horizontal, a supporting assembly coupled to an arm for displacement in a lateral and vertical sense on which said guide and feed unit is mounted providing two distinct work positions of the unit, said guide and feed unit having a flat entry guide for a cloth workpiece, and means for detection of the cloth edge and for realignment of said edge in said unit automatically when required.

3. An apparatus as in claim 2, further comprising:

means for pre-folding and for final folding of the cloth prior to stitching the hem by the sewing machine, said pre-folding means being operated by a piston and cylinder assembly for its displacement, means for moving the final fold means, means for sensing the arrival of the already sewn hem, said sensing means initiating the stopping of the apparatus and inclination of the entry roller.

4. An apparatus as in claim 2, wherein the main entry roller is made up of two parts, one fixed part and one rotating part, a transverse roller acting on the fixed part and being held on a support which is subject to a variable pressure from a piston and cylinder pneumatic device, said main entry roller having an inclination device actuated from the positioning of a photo-electric cell, said cell being positioned to detect the position of the edge of the cloth and controlled to cause realignment of said cloth as required.

5. An apparatus as in claim 2, wherein the flat entry guide for the material includes a flat fixed plate and a coincident second flat plate hinged on one of its vertical edges such that the material to be hemmed can be guided between said plates, photo-electric means to locate the edge of the material as fed between said plates, and a roller for realignment of said material, said roller being perpendicular to the plane of the guide plates for operating on said material through an aperture in the fixed plate with the pressure of a hinged arm on which said roller is mounted.

6. An apparatus as in claim 3, wherein the final fold means comprises a guide ring acting on the edge of the cloth, said guide ring being articulated at one extremity on a bridge member which is articulated at its other extremity to a fixed part on the machine, a magnet means positioned in opposition to said other extremity to retain the final fold means in position until the moment of entry of the already sewn hem, and means for swinging the final fold guide ring on two axes of articulation separating the final fold guide ring from the trajectory of the hem to permit joining the beginning and end thereof.

7. An apparatus as in claim 6, wherein said magnet means includes a pair of magnets of different strength, the magnet of greater strength retaining the articulated guide ring and bridge member firmly during the final folding while the magnet of lesser strength causes the return of the articulated guide ring and bridge member to their work position once the final joining of the beginning and end of the hem of the material has been carried out.

* * * * *